United States Patent [19]

Luke

[11] 4,285,538

[45] Aug. 25, 1981

[54] FLUE LINING INSTALLATION TOOL

[76] Inventor: Raymond J. Luke, 27 - 17th St., Cloquet, Minn. 55720

[21] Appl. No.: 138,906

[22] Filed: Apr. 10, 1980

[51] Int. Cl.[3] ..... B66C 1/44

[52] U.S. Cl. ..... 294/97

[58] Field of Search ..... 294/97, 95, 93, 94, 294/79, 80, 86.24, 86.25, 87.18; 29/237

[56] References Cited

U.S. PATENT DOCUMENTS

| | | | |
|---|---|---|---|
| 1,100,019 | 6/1914 | Johnson | 294/97 |
| 1,294,320 | 2/1919 | Storm | 294/97 |
| 1,569,918 | 1/1926 | Flynn | 294/97 |
| 2,670,233 | 2/1954 | Barchoff | 294/97 |
| 2,794,669 | 6/1957 | Schardinger | 294/97 |

*Primary Examiner*—James B. Marbert

*Attorney, Agent, or Firm*—Harvey B. Jacobson

[57] ABSTRACT

A vertically elongated tool is provided including an upper head portion and a pair of downwardly divergent legs each having its upper end pivotally supported from the head portion for oscillation relative thereto about an axis extending transversely of the legs, the pivot axes of the legs being parallel, and for relative swinging movement of the lower ends of the legs toward and away from each other. A horizontally elongated control block extends between and interconnects the legs intermediate their upper and lower ends. The legs and the control block include coacting guide structure attaching the ends of the control block to the legs for guided movement therealong, whereby upward and downward movement of the block along the legs swings the lower ends of the legs away and toward each other, respectively, the head and control block each including anchor structure for anchoring one end of an elongated tension and suspension member section thereto and the remote sides of the lower ends of the legs including structure for frictionally gripping the internal surfaces of a hollow flue lining block.

4 Claims, 4 Drawing Figures

FLUE LINING INSTALLATION TOOL

BACKGROUND OF THE INVENTION

When installing flue lining blocks in an existing chimney, the individual blocks must be internally gripped and lowered downwardly through the chimney into position with each successive flue lining block resting upon the upper end of the last installed flue lining block.

Although various forms of tools heretofore have been designed for internally gripping flue lining blocks to be downwardly inserted into a chimney for lining the latter, most of these previously known forms of tools are subject to slippage relative to the associated flue lining blocks or are time consuming to install and remove from each block.

Examples of previously known forms of flue lining blocks handling structures as well as other devices including some of the general structural and operational features of the instant invention are disclosed in U.S. Pat. Nos. 435,594, 952,095, 1,040,721, 1,100,019, 2,670,233, 2,794,669 and 4,085,958.

BRIEF DESCRIPTION OF THE INVENTION

The flue lining installation tool of the instant invention has been designed to facilitate replacement of flue lining blocks into existing chimney flues. The tool is fabricated primarily out of steel and rubber. The purpose of the tool is to assist in the placement of primarily ceramic flue lining blocks.

During the normal construction period, the flue is first constructed, with the liner installed later. Also, there are a considerable number of older buildings with conversion to wood or gas heating systems that need a flue liner to protect the mortar from corrosive action. The tool of the instant invention is specifically designed for the purpose of assisting the installation of flue liner blocks in such existing flues or chimneys, but may also be utilized for the purpose of installing flue lining blocks into new chimney flues.

The main object of this invention is to provide a tool which will be operative to tightly frictionally grip the inner surfaces of primarily ceramic flue lining blocks and to be utilized for lowering successive flue lining blocks into position within a chimney.

Another object of this invention is to provide a tool which also includes structural features enabling the tool to be quickly released from supportive engagement with the inner surfaces of a flue lining block after the latter has been placed in position within a chimney.

Yet another important object of this invention is to provide an installation tool which may be operated by unskilled workmen.

A further object of this invention is to provide a flue lining installation tool constructed in a manner whereby flue lining blocks of different sizes may be readily supported therefrom.

A final object of this invention to be specifically enumerated herein is to provide a flue lining installation tool in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
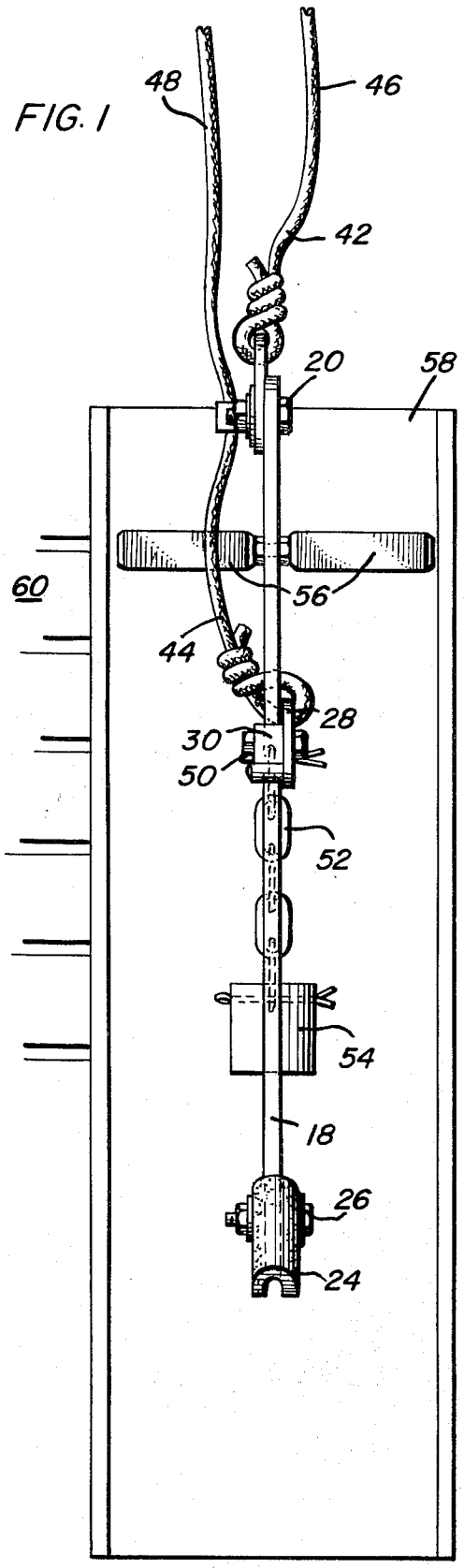
FIG. 1 is a side elevational view of the installation tool of the instant invention illustrated in operative position relative to a flue lining block.
Figure 2:
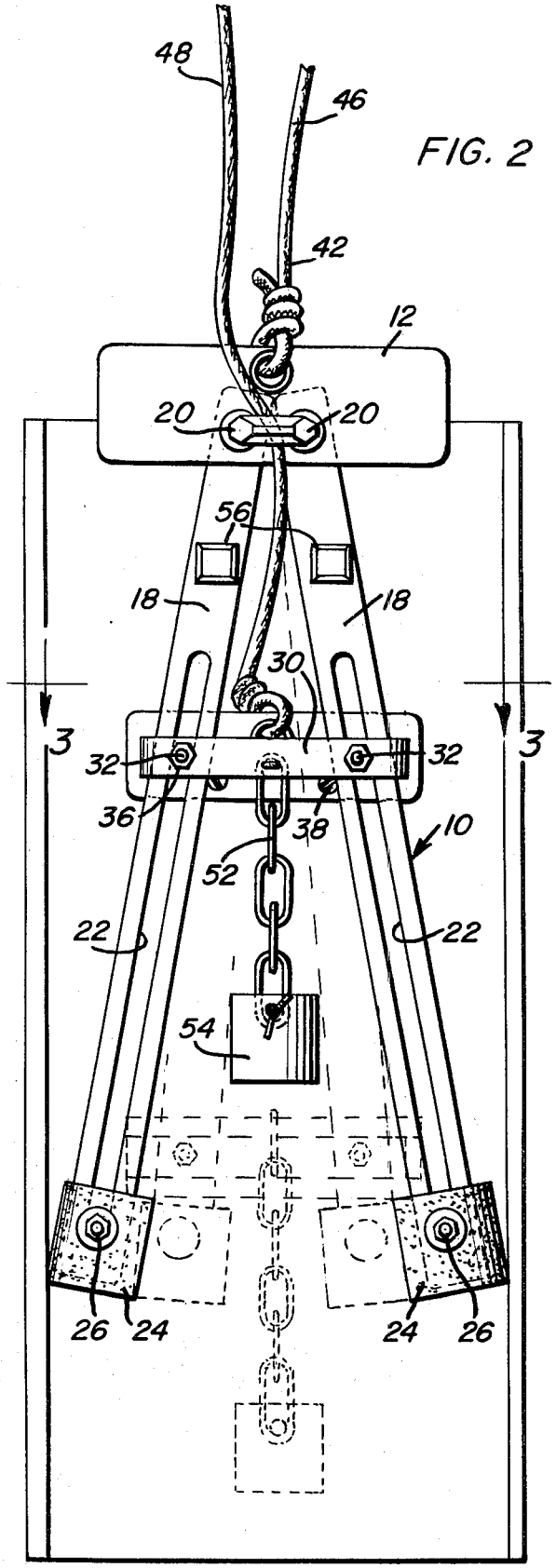
FIG. 2 is a front elevational view of the assemblage illustrated in FIG. 1.
Figure 3:
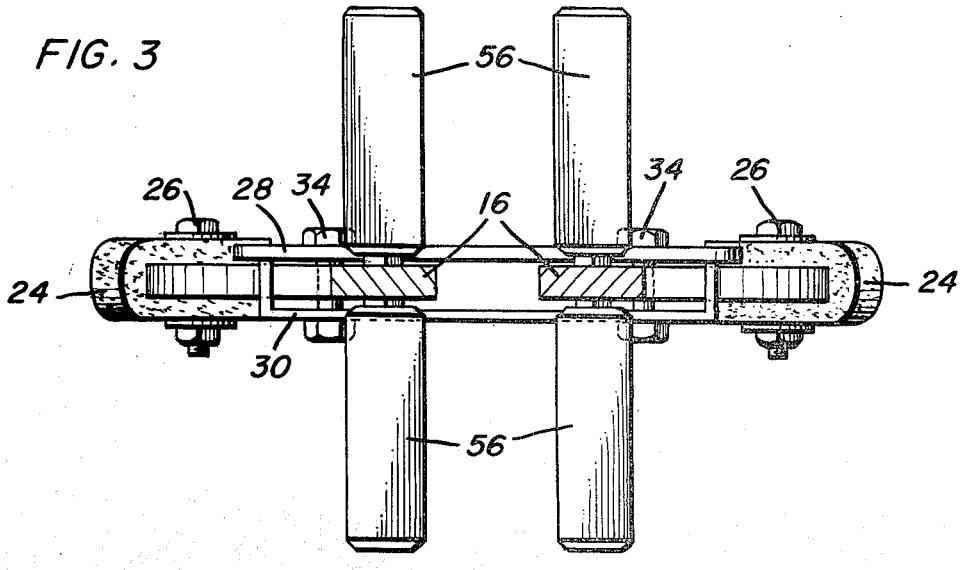
FIG. 3 is an enlarged horizontal sectional view taken substantially upon the plane indicated by the section line 3—3 of FIG. 2.
Figure 4:
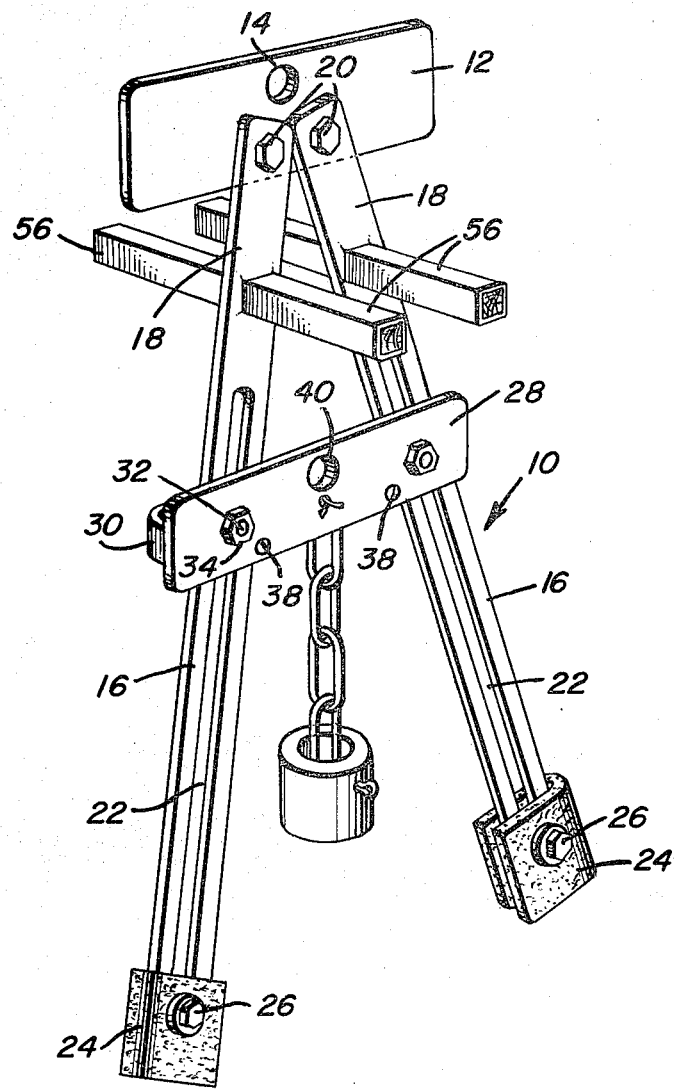
FIG. 4 is a perspective view of the tool.

Referring now more specifically to the drawings, the numeral 10 generally designates the tool of the instant invention and it may be seen from FIG. 4 of the drawings that the tool 10 includes an upper head portion 12 suitably apertured as at 14 for a purpose to be hereinafter more fully set forth. The head portion 12 comprising a horizontally elongated edge upstanding plate and the aperture 14 is formed in an upper portion of the head portion 12 centrally intermediate the opposite ends thereof. A pair of slightly downwardly divergent legs 16 have their upper end portions 18 pivotally anchored to opposite end portions of the head portion 12 through the utilization of suitable pivot fasteners 20 and the legs are longitudinally slotted as at 22 and have U-shaped resilient material covers or abutment members 24 secured over the lower ends thereof through the utilization of fasteners 26 secured through the lower ends of the slots 22.

A horizontally elongated control block or plate 28 is provided and includes a horizontal U-shaped bracket 30 secured to one side thereof with the legs 16 being captively received through the bracket 30. The opposite ends of the control block or plate 28 are suitably apertured and have one set of corresponding ends of guide pins 32 secured therethrough by fasteners 34, the other set of corresponding ends of the guide pins 32 being secured through the bracket 30 by fasteners 36. The guide pins 32 are slidably received in the slots 22 thereby supporting the opposite end portions of the control block or plate 28 from the legs 16 in a manner such that downward movement of the control block or plate 28 along the legs 16 swings the lower ends of the legs 16 toward each other and upward movement of the control block or plate 28 along the legs 16 swings the lower ends of the legs 16 away from each other.

A pair of second guide pins 38 equipped with roller sleeves (not shown) are supported from the control block or plate 28 inwardly of the adjacent sides of the legs 16 and the sleeves mounted on the pins 38 rollingly engage the opposing longitudinal edges of the legs 16. The central portion of the control block or plate 28 includes an aperture 40 corresponding to the aperture 14 and end portions 42 and 44 of a pair of elongated flexible tension member sections 46 and 48 are secured through the apertures 14 and 40. Further, a cotter pin 50 is secured through aligned central lower apertures formed in the bracket 30 and the control block or plate 28 and the upper link of a link chain section 52 is supported from the cotter pin 50. A suitable weight 54 is anchored to the lowermost link of the link chain section 52.

The upper end portions 18 of the legs 16 include opposite horizontally outwardly projecting abutments 56 and the outer ends of the abutments 56 are adapted to be spaced slightly inwardly of the opposing inner surfaces of an associated flue liner block 58.

In operation, an upstanding flue block is disposed on a suitable support surface and the tool 10 is lowered down into the interior of the block 58 through the utilization of the tension member section 46, the weight 54 and weight of the control block or plate 28 causing the latter to slide downwardly along the legs 16 and to swing the lower ends of the legs 16 toward each other and to thereby provide clearance for the legs 16 within the flue lining block 58. After the tool 10 has been lowered into the flue lining block 58 with the abutment members 56 below the upper end of the flue lining block, an upward pull is effected on the tension member section 48 in order to slide the control block or plate 28 upwardly along the legs 16 and to thus cause the lower ends of the legs 16 to swing away from each other and the remote surfaces of the covers 24 to frictionally grip the internal surfaces of the flue lining block 58. Thereafter, the tool and the engaged flue lining block 58 may be vertically raised through the utilization of the tension member section 48 while the tension member section 46 is maintained in a slack condition. The tool 10 may then be utilized, while supported from the tension member 48, to lower the flue lining block down into an associated chimney 60 for the purpose of lining the same. When the flue lining block 58 has been lowered to its final lowermost position, an upward pull is applied to the tension member section 46 while the upward pull on the tension member section 48 is terminated. After raising tension member section 46 two or three inches, the upward pull on the tension member 46 is released to create a downward bump and thereby expedite the release action and enable the weight 54 to cause the control block or plate 28 to slide downwardly along the legs 16 and the lower ends of the legs 16 to swing inwardly toward each other and release their frictional grip engagement with the inner surfaces of the flue lining block 58. Of course, the tension member section 46 is then utilized to upwardly withdraw the tool 10 from the flue lining block 58 and the associated chimney 60 preparatory to engaging and lowering the next flue lining block down into the chimney.

The abutment members 56 are spaced only slightly inwardly of the internal surfaces of the flue lining block 58 and thereby prevent the tool 10 from becoming "cocked" within the flue lining block 58. The abutment members 56 are releasably supported from opposite sides of the upper end portions 18 of the legs 16 and may therefore be readily replaced with shorter abutment members 56 if the tool 10 is to be utilized in conjunction with smaller cross section dimensioned flue lining blocks.

The tool 10 is approximately 22 inches long with a retracted width of approximately $6\frac{3}{4}$ inches and a fully expanded width at the outer surfaces of the covers 24 of approximately $11\frac{1}{2}$ inches. Of course, the space in between the guide pins 32 may be increased in order to increase the maximum expanded dimension of the tool 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flue pipe installation tool including an upper head portion, a pair of slightly downwardly divergent elongated and substantially longitudinally straight legs each having its upper end pivotally supported from said head portion for oscillation about an axis extending transversely of said head portion and the legs for relative swinging movement of the lower ends of the legs toward and away from each other, said legs each including a longitudinal slot formed therein, a horizontally elongated control block extending between and interconnecting said legs intermediate their upper and lower ends, each end of said block including pin means slidably received in the corresponding leg slot, whereby upward and downward movement of said block along said legs causes the lower ends thereof to swing away and toward each other, respectively, said head and control block each including anchor means for anchoring one end of an elongated suspension member section thereto, the pivot axes of said legs relative to said head portion being spaced horizontally apart in parallel relation, the remote portions of the lower ends of said legs including resilient portions thereof for frictionally gripping the internal surfaces of a flue lining block.

2. The combination of claim 1 wherein said tool includes abutment means above said control block defining oppositely facing abutment surfaces disposed on opposite sides of a plane generally centered relative to the planes in which said arms swing and disposed normal to the pivot axes of said legs, said abutment surfaces being spaced outwardly beyond a pair of planes disposed on opposite sides of the first mentioned plane, paralleling the latter and spaced outwardly of all other components of said tool.

3. The combination of claim 1 including a weight member suspended from the longitudinal midportion of said control block.

4. The combination of claim 1 wherein said resilient portions comprise resilient U-shaped abutment members carried by the lower ends of said legs and embracingly engaged therewith, said U-shaped members opening horizontally toward each other, whereby their closed portions face in opposite directions outwardly of remote sides of the lower ends of said legs for abutting frictional engagement with the internal surfaces of a flue lining block.

* * * * *